US006241515B1

(12) United States Patent
Nayar

(10) Patent No.: US 6,241,515 B1
(45) Date of Patent: Jun. 5, 2001

(54) DEVICE AND METHOD FOR TREATING COMBUSTIBLES OBTAINED FROM A THERMAL PROCESSING APPARATUS AND APPARATUS EMPLOYED THEREBY

(75) Inventor: Harbhajan Singh Nayar, Murray Hill, NJ (US)

(73) Assignee: TAT Technologies, INC, Murray Hill, NJ (US)

( * ) Notice: Subject to any disclaimer, the term of this patent is extended or adjusted under 35 U.S.C. 154(b) by 0 days.

(21) Appl. No.: 09/580,112

(22) Filed: May 30, 2000

(51) Int. Cl.[7] ..... F27B 5/04

(52) U.S. Cl. ..... 432/128; 432/11; 432/18; 432/128; 432/198; 266/171

(58) Field of Search ..... 432/2, 11, 18, 432/128, 130, 133, 155, 198; 266/171, 176, 177

(56) References Cited

U.S. PATENT DOCUMENTS

| | | | | |
|---|---|---|---|---|
| 4,266,967 | * | 5/1981 | Yamada et al. | 432/18 |
| 4,674,975 | * | 6/1987 | Corato et al. | 432/11 |
| 5,248,255 | * | 9/1993 | Morioka et al. | 432/128 |
| 6,106,281 | * | 8/2000 | Materna | 432/198 |

* cited by examiner

*Primary Examiner*—Gregory Wilson
(74) *Attorney, Agent, or Firm*—Watov & Kipnes, P.C.

(57) ABSTRACT

A device adapted for attachment to a thermal processing furnace, the device includes a housing having first and second openings with a chamber located therebetween, the second opening is operatively connected to a thermal processing furnace and in communication with the thermal processing furnace for receiving a thermal process generating gas stream containing combustibles from the thermal processing furnace, a gas supply assembly located within the chamber for supplying a heated oxygen-containing gas at a temperature and velocity sufficient to mix the combustibles and the oxygen-containing gas to oxidize the combustibles into harmless byproducts.

34 Claims, 3 Drawing Sheets

DEVICE AND METHOD FOR TREATING COMBUSTIBLES OBTAINED FROM A THERMAL PROCESSING APPARATUS AND APPARATUS EMPLOYED THEREBY

FIELD OF THE INVENTION

The present invention relates to a thermal processing apparatus for treating a heat treatable material, more particularly to a device and method adapted for use in conjunction with a thermal processing furnace to treat combustibles generated therein by converting the same to harmless byproducts.

BACKGROUND OF THE INVENTION

Thermal processing concerns the heat treatment of a heat treatable material (e.g. metal parts). The heat treatable material is heated to a desirable temperature and then cooled at a controlled rate. Thermal processing includes heat treating operations such as sintering, brazing, annealing, carburizing, and the like which require heating of materials to yield a particular material having selected physical properties. Prior to thermal processing, the material is typically formed into a compressed form from a powder in a desired shape or simply pre-casted or pre-formed as a solid piece.

Furnaces are utilized to carry out thermal processing either continuously or batchwise. Continuously operated furnaces have a length, typically of 50 to 100 feet and include a conveyor belt assembly for moving the parts for processing through the furnace. Batch furnaces typically have a shorter length. Such furnaces typically include an entryway for introducing the heat treatable material and an exitway for retrieving the heat treatable material as a finished part. The size of the entrance and exit openings may be adjusted by movable doors to accommodate parts of various sizes and shapes and to maintain the furnace atmosphere therein. The heat treatable material moves through the entryway and is carried within the furnace by the conveyor belt. The to remainder of the furnace is substantially gas-tight and thereby closed to the outside atmosphere.

Within the furnace, the heat treatable material is usually thermally processed in the presence of an atmosphere flowing therethrough. The atmosphere excludes ambient air which may interfere with the thermal processing, and functions as a heat treating gas to initiate a heat treating operation such as metal oxide reduction, carburizing, decarburizing, and the like. In addition, the atmosphere assists in removing undesirable vaporized materials from the thermal processing operation. The undesirable vaporized materials are derived from, for example, lubricants, binders, chemical vehicles, oils and the like. Removal of these materials from the heat treatable material may be performed before the onset of the thermal processing operation.

To remove undesirable vaporized materials before thermal processing, the atmosphere is usually introduced within the furnace in counter-current flow to the movement of the heat treatable material. The undesirable vaporized material which may in part be oxidized by the presence of residual oxygen may therefore be purged before the onset of the thermal processing operation.

Due to competitive and economic pressures, furnace operators typically exceed the rated capacity of a furnace to meet production orders. As a result, the undesirable vaporized materials are not completely oxidized before leaving the furnace creating environmental concerns. In addition, the undesirable vaporized materials may rise to dangerous levels within the furnace and associated exhaust systems thus creating safety and fire hazards. Still further, the undesirable vaporized materials may also remain in the heat treatable material resulting in inferior quality products. The increased production rate may also diminish the capacity of the furnace to properly heat the parts to a desired temperature for enabling complete thermal processing.

It would be of significant advantage in the art of thermal processing to provide a device adapted for association with thermal processing furnaces for increasing production output capacity and improving the quality of exhaust emissions while maintaining a high yield of quality products in a cost effective and energy efficient manner.

SUMMARY OF THE INVENTION

The present invention is generally directed to a device associated with, either integrally or as a removable attachment, a thermal processing furnace for the heat treatment of heat treatable materials and to methods and thermal processing furnaces employing the same. The device provides a reaction zone for the oxidation of combustibles (i.e. undesirable vaporized materials) obtained from the thermal processing furnace as well as combustibles which may be generated in the present device as the heat treatable materials pass therethrough. Control of the amount of oxygen and the temperature within the present device enables at least substantially complete oxidation of the combustibles into harmless byproducts without significant oxidation of the heat treatable material. In addition, the present device serves the additional purpose of pre-heating the heat treatable material.

The present device is comprised of a housing having first and second openings and a chamber located therebetween with means for transporting the heat treatable material through the device into the thermal processing furnace. The second opening is in communication with an interior portion of a thermal processing furnace and receives the atmosphere (i.e. a gas stream containing combustibles) from the thermal processing furnace. A gas supply assembly is associated with the chamber for supplying an oxygen-containing gas to the chamber at a temperature and velocity sufficient to mix and react the atmosphere containing the combustibles and oxygen-containing gas to oxidize the combustibles into harmless byproducts. Control of the oxygen content and temperature within the reaction zone of the chamber enables at least substantially complete oxidation of the combustibles while preventing any appreciable oxidation of the heat treatable material.

In one aspect of the present invention there is provided a device operatively associated with a thermal processing furnace, the device comprising:

- a housing having first and second openings and a chamber located therebetween;
- means for transporting the heat treatable material from the first opening to the second opening;
- said second opening being in communication with a thermal processing furnace for receiving a thermal process generated atmosphere containing combustibles from said thermal processing furnace during the heat treatment of the heat treatable material; and
- an oxygen-containing gas supply assembly for supplying an amount of oxygen-containing gas to the chamber at a temperature and velocity sufficient to mix and react the atmosphere containing combustibles and oxygen-containing gas to oxidize at least substantially all of said combustibles into harmless byproducts without substantially oxidizing the heat treatable material.

In another aspect of the present invention, there is provided a method of oxidizing at least substantially all of the combustibles obtained from a thermal processing furnace comprising:

operatively associating with a thermal processing furnace, a housing having first and second openings with a chamber communicating therebetween;

drawing a thermal process generated atmosphere containing combustibles from said thermal processing furnace through said second opening into said chamber;

delivering an amount of oxygen-containing gas to the chamber at a temperature and velocity into said chamber sufficient to mix and react the atmosphere containing combustibles and oxygen-containing gas to oxidize at least substantially all of said combustibles into harmless byproducts without substantially oxidizing the heat treatable material; and removing the harmless byproducts from said chamber.

A thermal processing furnace including the device described above is also encompassed within the present invention.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

The present invention is generally directed to a device for operation in conjunction with a thermal processing furnace that provides oxidation of at least substantially all undesirable vaporized materials or combustibles without substantial oxidation of the heat treatable material.

As used herein the term "at least substantially all" as applied to the undesirable vaporizable materials or combustibles shall mean that all of the combustibles are oxidize or all but an amount of less than 10% by volume, preferably less than 5% by volume.

As used herein the term "without substantial oxidation" as applied to the heat treatable material shall mean that there is no resulting oxidation of the heat treatable material or only a minor amount which does not affect the quality of the resulting product.

Figure 1:
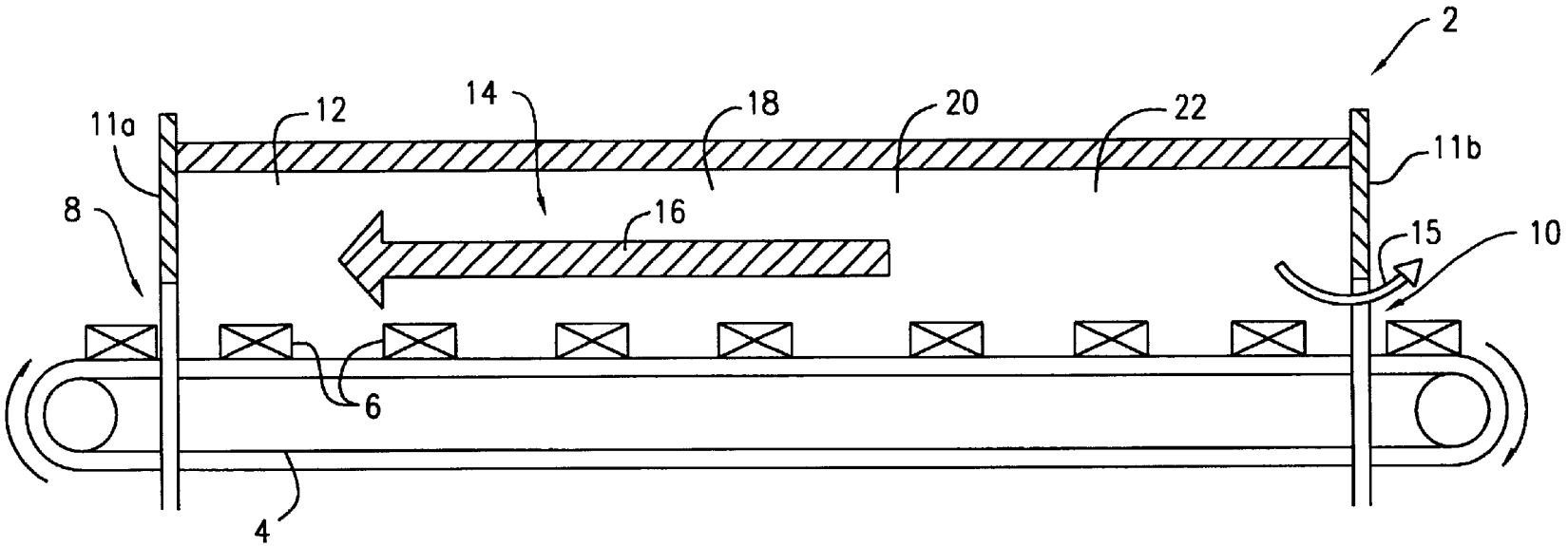
FIG. 1 is a schematic side cross-sectional view of a typical continuous thermal processing furnace.

Referring to FIG. 1, there is shown a typical continuous thermal processing furnace identified by the numeral 2. While the present invention will be described in its preferred embodiment as being adaptable for use with the continuously operational furnace 2, it will be understood that the invention may be implemented for use with any furnace including batchwise furnaces which would benefit from the conversion of combustibles generated within the furnace into harmless byproducts before their emission to the outside atmosphere.

The furnace 2 includes a conveyor belt 4 for transporting a heat treatable material (e.g. steel) shown as a plurality of preformed parts 6 from an entrance opening to an exit opening 10 thereof. Sliding doors 11*a*, 11*b* may be provided at each opening 8, 10, respectively, to control the flow of the thermal process generated atmosphere within the furnace 2 as will be described hereinafter and to permit the parts 6 to enter and egress with sufficient clearance. It is desirable to have the entrance opening 8 larger (i.e. greater cross-sectional area) than the exit opening 10 to assist in moving the thermal process generated atmosphere in the direction of the arrow 16 and toward the entrance opening 8.

The parts 6 may be preformed into various sizes and shapes prior to heat treating in a conventional manner such as by compressing a powder of the heat treatable material. Typically the powder composition will contain at least one organic lubricant such as ethylene bisstearamide. The lubricant and other additives are typically vaporized during thermal processing and become a source of combustibles.

Each part 6 enters the entrance opening 8 of the furnace 2 and passes through several stages of thermal processing as will be described. Each stage represents a different heating temperature and residence time combination. The parts 6 first enter a pre-heat stage 12 on the conveyor belt 4. In the pre-heat stage 12, the parts 6 are gradually heated to a temperature of typically from about 800 to 1600° F. In stage 12, the organic lubricant is gradually vaporized and purged from the parts 6. Other organic contaminants which may be present, are also purged during the pre-heat stage 12.

The furnace 2 further includes an atmosphere in the form of a gas stream 14 which is introduced at several points within the furnace 2 and flows generally in the direction represented by the arrow 16 which is counter-current to the movement of the parts 6. The atmosphere typically is selected according to the desirable heat treating operation which is to be performed such as sintering, brazening and the like. Though most of the gas stream 14 escapes through the entrance opening 8, a portion 15 of the gas stream 14 also leaves the furnace 2 through the exit opening 10. The gas stream 14 may be composed of, for example, mainly nitrogen and hydrogen of a suitable ratio which is dependent on the type of material being processed. The gas stream 14 prevents ambient atmosphere from interfering with the thermal processing within the furnace 2 and provides gaseous compounds for inducing desirable chemical reactions, i.e. metal oxide reduction, carburizing, decarburizing, in the treated parts during thermal processing.

Near the end portion of the pre-heat stage 12, the temperature is at the upper end of the temperature range, for example, from about 1400 to 1600° F. The hydrogen in the atmosphere gas stream 14 reduces any metal oxides on the surface of the part 6, thus generating water as a by-product. The water is removed by the countercurrently flowing gas stream 14.

The parts 6 next enter a higher temperature stage 18 where the temperature peaks, for example, at about 2050° F. In stage 18, the molecules of the parts 6 form strong interparticle bonding. After the high-heat stage 18, the parts 6 must be cooled in a controlled manner to ambient temperature. Cooling typically occurs in a slow cool stage 20 and then in a fast cool stage 22. Once the parts 6 reach ambient temperature, the thermal processing is complete.

The present device is associated with a thermal processing furnace of the type shown and described in connection with FIG. 1. The device may be integral with the thermal processing furnace and therefore collectively manufactured as a single unit. Alternatively, the present device may be attached to either permanently or removably, to the furnace and thereby function as a retrofit device.

Figure 2:
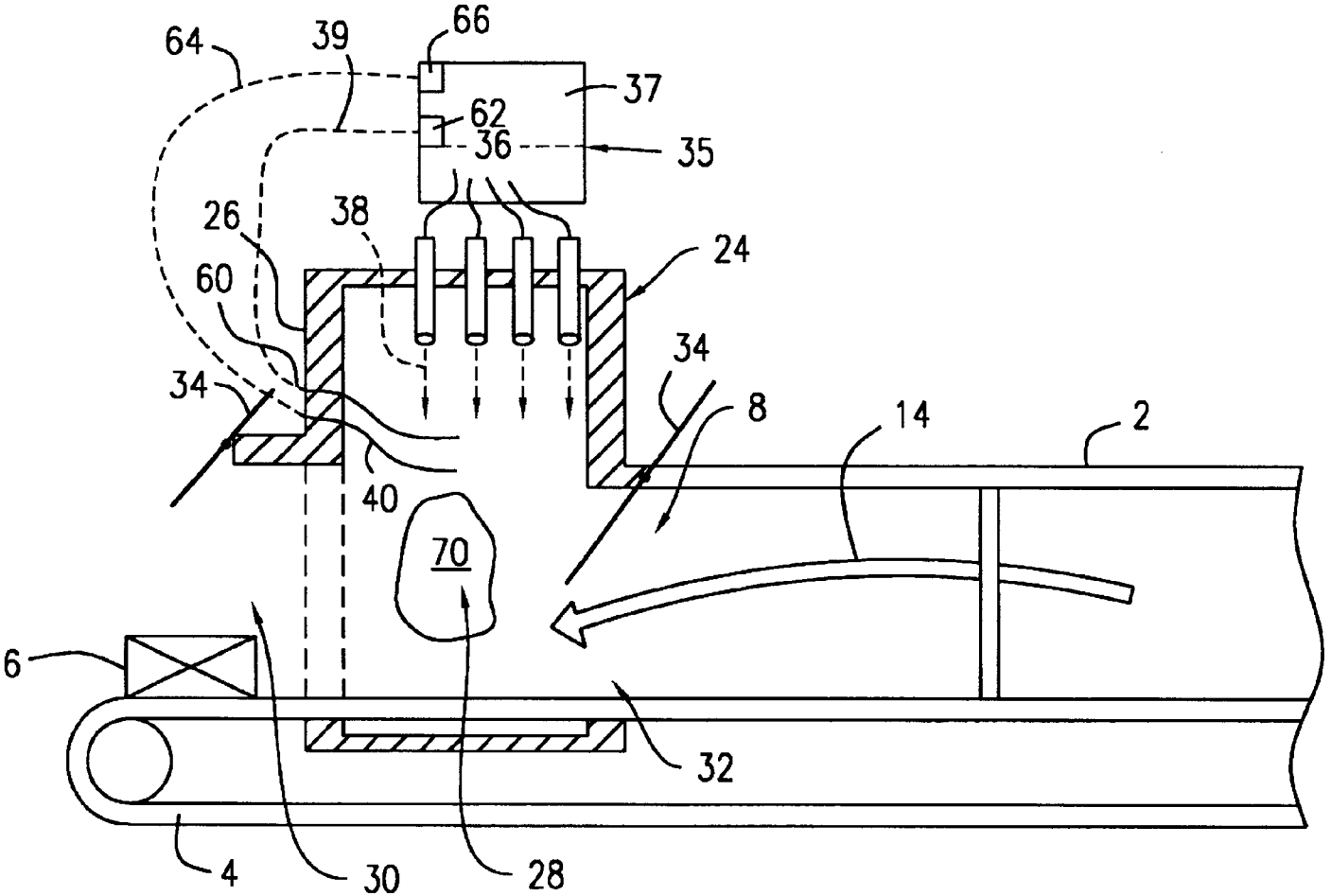
FIG. 2 is a cross sectional side view of a first embodiment of a device of the present invention as associated with a furnace of the type shown in FIG. 1.

Referring to FIG. 2, there is shown an embodiment of a device 24 of the present invention operatively associated with a thermal processing furnace 2. The device 24 includes a housing 26 defining a chamber in which the reaction of the combustibles and an oxygen-containing gas occurs. The oxygen-containing gas is provided from a source 35 to a device for distributing the oxygen-containing gas uniformly into the chamber 28. As specifically shown in FIG. 2, a plurality of injectors 36 are provided. The injectors 36 may be in the form of conduits or may be in the form of nozzles to enable the gas to be injected under relatively higher velocities than can be obtained using conduits alone. The oxygen-containing gas is injected into the chamber to enable intimate mixing with the combustibles entering from the thermal processing furnace 2.

The oxygen-containing gas may be heated prior to entry into the chamber 24. A heater 37 is provided proximate to the gas source 35 for this purpose.

Control of the temperature and amount of oxygen within the chamber 24 is an important aspect of the present invention to provide oxidation of at least substantially all of the combustibles while minimizing and preferably avoiding any oxidation of the parts 6. In a preferred aspect of the invention, the device 24 is provided with a temperature control system and/or a system for controlling the amount of oxygen within the chamber 28 and especially within the reaction zone of the chamber as hereinafter described.

As shown in FIG. 2, a temperature control assembly 39 includes a thermocouple 60 which measures the temperature within the reaction zone of the chamber 28 and transports a signal corresponding to the temperature to a temperature controller 62 within the heater 37 which can thereby change the temperature of the oxygen-containing gas to a predetermined level. Temperature control assemblies of the type employed herein are known and readily available.

An oxygen gas monitoring or oxygen probe assembly 64 may be provided to detect the level of oxygen or oxidation potential in the reaction zone of the chamber 28 and to adjust the amount of the oxygen-containing gas entering the chamber 28 to maintain the amount of oxygen at a predetermined level. The oxygen monitoring assembly includes an oxygen sensor 40 which transmits a signal corresponding to the level of oxygen in the reaction zone to an oxygen-containing gas controller 66 associated with the gas source 35. Oxygen monitoring assemblies of this type are conventional and readily available.

As previously indicated, the combustibles and oxygen-containing gas react in the chamber 28. Most of the reactants react with each other in a reaction zone identified by the numeral 70 typically located between the center of the chamber 24 and the entrance opening 30. While the position of reaction zone 70 may vary, it is located toward the entrance opening 30 because of the force in that direction provided by the combustibles 14 as they flow into the chamber 28 in the direction of the arrow. The reaction conditions in the reaction zone 70 are desirably maintained to maximize oxidation of the combustibles while at least minimizing if not entirely eliminating oxidation of the parts 6.

During operation of the device 24, the gas stream 14 flows from the thermal processing furnace 2 into the chamber 28 carrying the combustibles including vaporized organic lubricant and other undesirable vaporized materials. The gas injectors 36 deliver the oxygen-containing gas 38 which may be heated into the chamber 28 at a velocity sufficient to provide for the oxidation of the combustibles.

The oxygen-containing gas 38 may be any gas composition containing oxygen having varying ratios of oxygen such as ambient air, nitrogen containing gases containing 5 to 95% oxygen, mixtures of ambient air and oxygen, or pure oxygen and the like. Preferred gases are those containing from 20 to 100% by volume of oxygen. It is preferable for the oxygen-containing gas 38 to be delivered at a velocity sufficient for intimately mixing with the gas stream 14 within the chamber 28 to promote oxidation of the combustibles. The optional heating of the oxygen-containing gas 38 may be achieved by electrical heating, waste-heat exchangers, gas-fired heat exchangers and the like to temperatures typically from about 600 to 1600° F.

Heated oxygen-containing gas 38 may also be generated by combusting air or a nitrogen and oxygen gas composition with a fuel such as natural gas, methane, propane, or LPG where the oxygen to fuel ratio is significantly greater than the stoichiometric ratio. Optionally the nitrogen and oxygen gas composition may be heated to a temperature from about 400° to 1500° F. before mixing with fuel. After combustion, the temperature of the resulting oxygen-containing gas is from about 1000° to 2000° F.

The flow rate of the gas stream 14 is preferably within the range of 500 to 2000 cubic feet per hour and the flow rate of the oxygen-containing gas 38 is typically about half of the flow rate of the gas stream 14. It is important that the temperature and oxygen content within the reaction zone 70 are at a level sufficient to oxidize at least substantially all the combustibles in the atmosphere gas stream 14 without oxidizing the parts 6. The temperature within the reaction zone 70 of the chamber 28 is preferably within the range of from about 700° to 1700° F. and more preferably within the range of from about 900° to 1500° F. to insure sufficient thermal energy to achieve at least substantially complete oxidation of the combustibles reaction.

Control of the level of oxygen in the reaction zone 70 is a further aspect of the present invention which enables oxidation of at least substantially all of the combustibles without deleterious oxidation of the heat treatable material. In particular, it is preferred that the amount of oxygen within the reaction zone be maintained at a level sufficient to react with all of the combustibles contained within the chamber. While in theory a stoichiometric amount of oxygen necessary to react with the combustibles is preferred, it has been observed that a greater than stoichiometric amount of oxygen is typically employed to insure complete oxidation. However, the amount of oxygen can not reach a level which will result in significant oxidation of the heat treatable material. In a most preferred form of the invention, the amount of oxygen in the reaction zone should be maintained at a level of from about 0.1 to 5.0% by volume.

The oxygen gas monitoring assembly previously described in connection with FIG. 2 may be used to monitor the level of oxygen in the reaction zone 70 and to adjust the flow rate of the oxygen-containing gas to the chamber 28 to insure the proper oxygen level within the reaction zone 70.

Once the combustibles in the gas stream 14 are oxidized, the resulting gas mixture of predominantly harmless byproducts is ejected through the entrance opening 30 for removal by an exhaust system (not shown). Because the exhaust contains little if any undesirable vaporized materials, the gas mixture may be ejected to the atmosphere with little if any treatment by a separate and often costly emission control system.

In addition to oxidizing undesirable vaporized materials, the device 24 operates as a pre-heater to expand the heating capacity of the furnace 2 and thereby increase production rate of the heat treatable material. The heat optionally supplied by the oxygen-containing gas 38 and the heat generated by the oxidation of the combustibles within the chamber, together, with heat supplied by the combustibles from the furnace 2 provide heat for pre-heating the parts 6 before entering the furnace 2. In this manner, the parts 6 are properly heated to a desired pre-heat temperature before thermal processing occurs.

Figure 3:
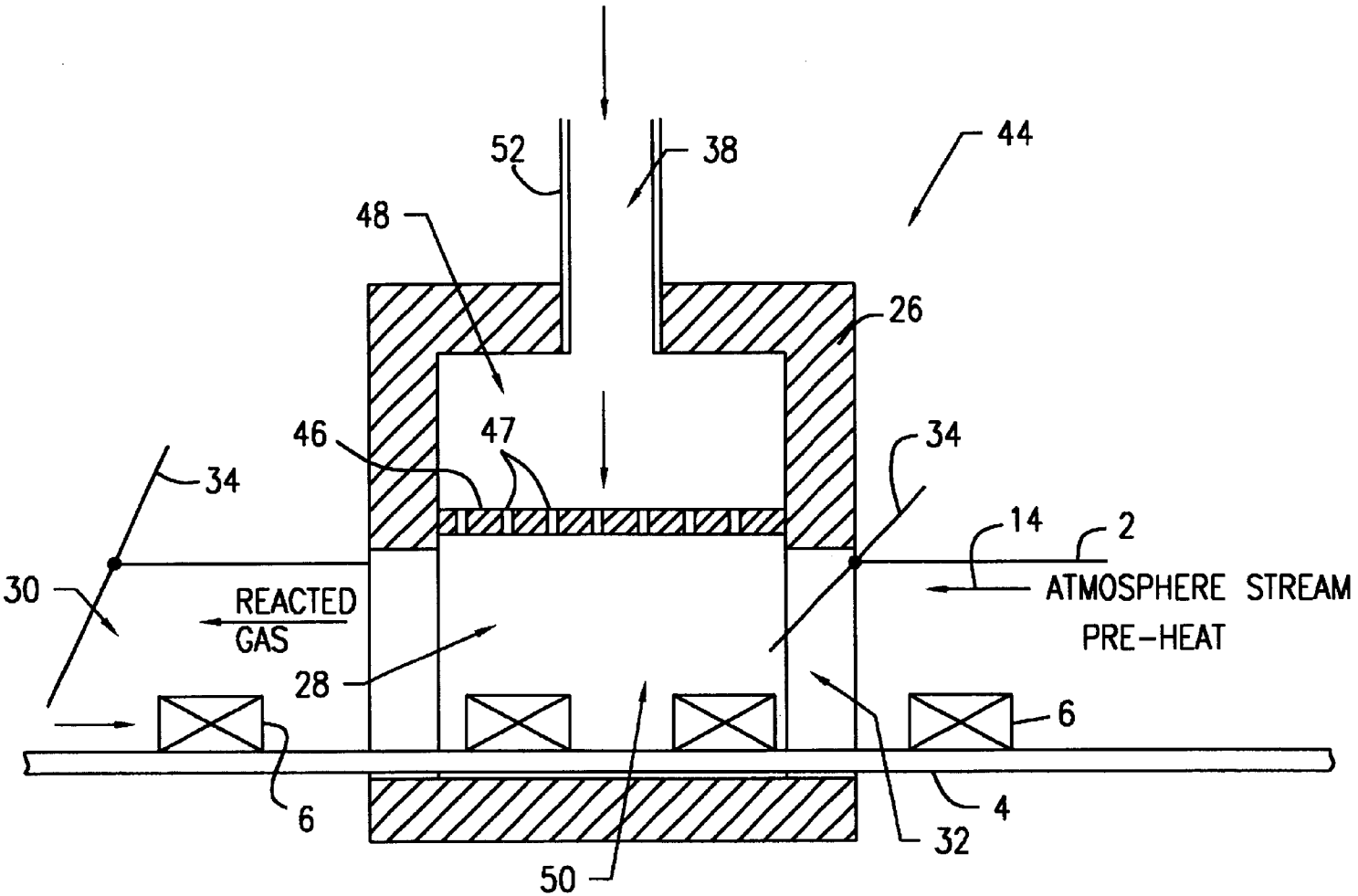
FIG. 3 is a cross sectional side view of a second embodiment of a device of the present invention.

Referring to FIG. 3, an alternate embodiment of a device of the present invention is shown. For this embodiment, the device 44 employs a housing 26 and a chamber 28 substantially similar in construction to the embodiment of FIG. 2. The device of 44 includes a gas plate 46 with a plurality of openings 47, mounted substantially parallel to the movement of the parts 6 within the chamber 28 to thereby partition the chamber 28 into an upper portion 48 and a lower 50 portion which contains a reaction zone 70. The plurality of openings 47 enable an oxygen-containing gas 38 from a source 35 (See FIG. 2) to pass from the upper portion 48 of the chamber 28 through the gas plate 46 to the lower portion 50 of the chamber. The upper portion 48 includes a gas supply duct 52 for delivering the oxygen-containing gas 38 at a desired velocity. The oxygen-containing gas passes through the gas plate 46 via the openings 47 for generating a thorough mixing of the oxygen-containing gas 38 and the gas stream 14 within the lower portion 50 of the chamber 28. The combustibles are thereby efficiently oxidized without oxidizing the parts 6 and the harmless byproducts are thereafter expelled through the entrance opening 30 as described in connection with the embodiment of FIG. 2.

The embodiment of the invention shown in FIG. 3 may also and preferably include a temperature control assembly 39 and/or an oxygen gas monitoring assembly 64 of the type shown and described in connection with FIG. 2.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as encompassed by the following claims.

EXAMPLE 1

A furnace having an 18 inch wide conveyor belt muffled with about a 6 inch clearance and throat of 18 inches comprises a pre-heat section measuring 14 feet with 3 temperature zones of 1000°, 1400° and 1800° F., a 20 foot long hot-zone section at 2050° F., followed by a cooling section measuring 30 feet in length and was employed to heat treat a steel composition in addition to containing iron, contains copper, carbon and lubricant (e.g. Acrawax) in a weight ratio of 2.0:0.8:1.0. Each metal part weighed about 225 grams and had a density of 6.6 gm/cc.

The conveyor belt was operated at a belt speed of 6 inches per minute to accommodate 400 pounds per hour of the metal parts. The metal parts were treated in an atmosphere as follows:

1600 cubic feet/hour (CFH) of nitrogen and 170 CFH of hydrogen were injected into the hot zone of the furnace. 150 CFH of nitrogen was supplied between the pre-heat section and the hot zone. 50 CFH of nitrogen was supplied at the end of the cool section. The total atmosphere entering the furnace was 1975 CFH.

The furnace was equipped with a device in accordance with the present invention as shown in FIG. 1 comprising a housing having first and second openings and a chamber located therebetween. The approximate inside dimensions of the chamber was 20 inches long and 19 inches wide to accommodate the passing of the 18 inch wide conveyor belt through the housing. The housing measured 9 inches high. The second opening was in communication with the pre-heat section of the furnace and was able to receive the atmosphere stream containing combustibles from the pre-heat section of the furnace through a door which was adjustable to give a clearance of about 3 inches. A similar door was provided at the first end of the device to give clearance of about 5 inches and thereby provide about 60% larger opening than the opening between the device and the pre-heat section of the furnace to aid in moving the stream of combustibles from the furnace into the present device.

The device included a plenum above the housing to both receive an oxygen-containing gas and distribute the gas into the chamber via a plurality of relatively small openings in the manner shown in FIG. 3. In this Example, three ⅛th inch wide slits were located along the entire width of the chamber and equally spaced in the middle half of the housing. 320 CFH of air of ambient temperature was supplied to the chamber via the plenum. The incoming air had sufficient velocity to mix with the relatively hot atmosphere stream coming from the pre-heat section of the furnace. The oxygen present in the chamber from the oxygen-containing gas and the combustibles from the atmosphere stream reacted to oxidize hydrogen and most of the lubricant vapors. The reaction produced exothermic heat to raise the temperature of the final mixture to about 800° F. The oxygen content in the reactive mixture within the reaction zone was about 5%.

The introduction of the oxygen-containing gas at ambient temperatures into the device reduced the amount of escaping lubricant vapors considerably. Furthermore, there was no soot or any evidence of oxidation on the metal parts.

EXAMPLE 2

The same furnace described in Example 1 was employed and the same conditions were maintained except that 400 CFH of air as the oxygen-containing gas was pre-heated to 1000° F. before being introduced into the reaction chamber by passing the oxygen-containing gas through an electrical heater. The temperature of the final reacted mixture was from about 1000° F. to 1150° F. and the oxygen content measured between 0.2 and 1.0%. It was observed that there were essentially no lubricant vapors emitted from the chamber. In particular, there was visible "white smoke" typically associated with lubricant vapors. The interior of the pre-heat section of the furnace was free of lubricant deposits and there was no soot observed on the conveyor belt or other components of the furnace. Furthermore, there was no evidence of oxidation on the parts.

EXAMPLE 3

The furnace and device of the present invention as described in Example 2 is used in conjunction with 600 CFH of air as a oxygen-containing gas and 20 CFH of natural gas which are heated in either the same manner as in Example 2 using an electric heater or by employing heat obtained from a heat exchanger through the reprocessing of waste heat. The temperature in the reaction zone is in the range of from about 1200 to 1500° F. depending upon the degree of insulation used near the reaction zone. There is essentially no lubricant vapors emitted from the chamber and no evidence of oxidation on the parts.

What is claimed is:

1. A device operatively associated with a thermal processing furnace for heat treating a heat treatable material, said device comprising:

a housing having first and second openings and a chamber located therebetween;

means for transporting the heat treatable material from the first opening to the second opening;

said second opening being in communication with a thermal processing furnace for receiving a thermal process generated atmosphere containing combustibles from said thermal processing furnace during the heat treatment of the heat treatable material; and an oxygen-containing gas supply assembly for supplying an amount of oxygen-containing gas to the chamber at a temperature and velocity sufficient to mix and react the atmosphere containing combustibles and oxygen-containing gas to oxidize at least substantially all of said combustibles into harmless byproducts without substantially oxidizing the heat treatable material.

2. The device of claim 1 wherein the chamber contains a reaction zone wherein the atmosphere containing combustibles and oxygen-containing gas react, said gas supply assembly further comprising oxygen-containing gas control means for supplying the oxygen-containing gas to the chamber in an amount sufficient to oxidize at least substantially all of the combustibles.

3. The device of claim 2 wherein the amount of oxygen in the reaction zone is greater than a stoichiometric amount needed to react with the combustibles.

4. The device of claim 3 wherein the amount of the oxygen in the reaction zone is from about 0.1 to 5.0% by volume.

5. The device of claim 2 wherein the gas supply assembly further comprises temperature control means for controlling the temperature of the oxygen-containing gas entering the chamber so that the oxygen-containing gas within the chamber oxidizes the combustibles without substantially oxidizing the heat treatable material.

6. The device of claim 5 wherein the temperature control means controls the temperature of the oxygen-containing gas at a level in which the reaction zone is maintained at a temperature of from about 700 to 1700° F.

7. The device of claim 6 wherein the temperature of the reaction zone is from about 900 to 1500° F.

8. The device of claim 2 further comprising temperature sensing means operatively connected from the chamber to the gas supply means for detecting the temperature within the reaction zone and for adjusting the temperature of the oxygen-containing gas supplied to the chamber to maintain the temperature of the reaction zone at a predetermined level.

9. The device of claim 2 further comprising oxygen sensing means operatively connected from the chamber to the gas supply means for detecting the presence of oxygen within the reaction zone and for adjusting the amount of the oxygen-contained gas supplied to the chamber to maintain the concentration of oxygen in the reaction zone at a predetermined level.

10. The device of claim 1 wherein the atmosphere containing combustibles includes vaporized materials from the heat treatable material while the heat treatable material passes from the first to the second openings.

11. The device of claim 1, further comprising an exhaust assembly for removing the harmless byproducts from the chamber.

12. The device of claim 1, wherein the oxygen-containing gas supply assembly comprises a plurality of oxygen-containing gas injecting nozzles.

13. The device of claim 1, wherein the oxygen-containing gas injecting nozzles extend from at least one of a top portion and a side portion of the housing into the chamber.

14. The device of claim 1, wherein the gas supply assembly comprises a source of the oxygen-containing gas, a plate in fluid communication with the source of the oxygen-containing gas having a plurality of openings for the passage of the oxygen-containing gas therethrough.

15. The device of claim 14 wherein the plate is mounted within the chamber to form an upper portion and a lower portion containing a reaction zone.

16. The device of claim 1 wherein the first opening has a cross-sectional area greater than the second opening.

17. The device of claim 1, wherein the temperature control means comprises a heat supply means selected from the group consisting of electrical heaters and heat exchangers for heating said oxygen-containing gas.

18. The device of claim 1 wherein the oxygen-containing gas supply comprises means for reacting an excess of a first oxygen-containing gas with a fuel to generate a second oxygen-containing gas and heat.

19. The device of claim 1 wherein the oxygen-containing gas contains from about 20 to 100% by volume of oxygen.

20. The device of claim 1 wherein the oxygen-containing gas comprises oxygen and nitrogen.

21. A method of converting thermal process generated combustibles from a thermal processing furnace into harmless byproducts, said method comprising the steps of:

drawing the combustibles from the thermal processing furnace into a housing having first and second openings with a chamber communicating therebetween while passing a heat treatable material therethrough;

delivering an oxygen-containing gas into said chamber at a temperature and velocity sufficient to mix and the combustibles and oxygen-containing gas to oxidize at least substantially all of said combustibles into harmless byproducts without substantially oxidizing the heat treatable material; and removing the harmless byproducts from said chamber.

22. The method of claim 21 comprising controlling the flow of the oxygen-containing gas to the chamber to enable the combustibles and oxygen-containing gas to react within a reaction zone of the chamber.

23. The method of claim 22 wherein the amount of oxygen is greater than a stoichiometric amount needed to react with the combustibles.

24. The method of claim 23 wherein the amount of the oxygen-containing gas is sufficient to provide an amount of oxygen in the reaction zone of from about 0.1 to 5.0% by volume.

25. The method of claim 21 further comprising controlling the temperature of the oxygen-containing gas entering the chamber so that the oxygen-containing gas within the chamber oxidizes the combustibles without substantially oxidizing the heat treatable material.

26. The method of claim 25 comprising controlling the temperature of the oxygen-containing gas at a level in which the reaction zone is maintained at a temperature of from about 700 to 1700° F.

27. The method of claim 26 wherein the temperature of the reaction zone is from about 900 to 1500° F.

28. The method of claim 21 further comprising detecting the temperature within the reaction zone and adjusting the temperature of the oxygen-containing gas supplied to the chamber to maintain the temperature of the reaction zone at a predetermined level.

29. The method of claim 21 further comprising detecting the presence of oxygen or determining the oxidation potential within the reaction zone and adjusting the amount of the oxygen-containing gas supplied to the chamber to maintain the concentration of oxygen in the reaction zone at a predetermined level.

30. The method of claim 21 wherein the combustibles further comprise undesirable vaporized materials from the heat treatable material while the heat treatable material is within the chamber.

31. The method of claim 21 wherein the step of delivering the oxygen-containing gas to the chamber comprises reacting a first oxygen-containing gas with a fuel to form a second oxygen-containing gas and heat and delivering the second oxygen-containing gas and heat to the chamber.

32. The method of claim 21 wherein the oxygen-containing gas contains from about 20 to 100% by volume of oxygen.

33. The method of claim 21 wherein the oxygen-containing gas comprises oxygen and nitrogen.

34. A thermal processing furnace comprising:

a furnace chamber having first and second ends, said furnace chamber being adapted to receive a heat treatable material through the first end and to heat treat the heat treatable material moving from said first end to said second end; and a housing having a first opening and a second opening with a chamber in communication therebetween operatively engaged to the first end of the furnace chamber for permitting passage of said heat treatable material therethrough into the first end of said furnace chamber, said housing receiving a thermal process generated atmosphere containing combustibles through said second opening and an oxygen-containing gas supply assembly for supplying an amount of an oxygen-containing gas to the chamber at a temperature and velocity sufficient to mix and react the combustibles and oxygen-containing gas to oxidize at least substantially all of said combustibles into harmless byproducts without substantially oxidizing the heat treatable material.

* * * * *